US006258176B1

(12) United States Patent
Ma

(10) Patent No.: US 6,258,176 B1
(45) Date of Patent: Jul. 10, 2001

(54) PROCESS FOR CONTINUOUS SEPARATION OF GLUCOSE AND FRUCTOSE

(76) Inventor: Hsien-Chih Ma, 15 Continental Rd., Morris Plains, NJ (US) 07950

( * ) Notice: Subject to any disclaimer, the term of this patent is extended or adjusted under 35 U.S.C. 154(b) by 0 days.

(21) Appl. No.: 09/595,235

(22) Filed: Jun. 16, 2000

Related U.S. Application Data

(63) Continuation of application No. 09/274,708, filed on Mar. 23, 1999.

(51) Int. Cl.[7] ..... C13D 3/14; C13D 3/12
(52) U.S. Cl. ..... 127/46.1; 127/46.2
(58) Field of Search ..... 127/46.1, 46.2

*Primary Examiner*—David Brunsman

(57) ABSTRACT

The process implements a new mass transfer method by eliminating the displacement zone and fully utilizing the void volume in chromatography for proceeding prompt and efficient mass transfer proceeding between two phases. Said new method further integrates with a differential set-up protocols between solid phase resin and a multiplicity of liquid mixtures, an operation protocol, and an apparatus to implement all above indicated methods. By the virtue of said new mass transfer method and differential set-up, the process herein disclosed is capable of continuous separation of glucose and fructose feed solution into 100% yield of respective pure component. Said process is operated by simultaneously proceeding of feeding, fraction recovery, and enhancing concentration of separated fractions through a single stage recycle procedures. It cutbacks nearly 50% of resin stock compared under same feed throughput with SMB process that has separation of 88% recovery of 90% fructose purity in product stream.

12 Claims, 10 Drawing Sheets

Liquid
Zone 1
Zone 2
Zone 3
Zone 4
Zone 5
Zone 6
6
5
11
13
10
14
15
12
16
22
21
20
19
18
33
32
31
28
30
29
24
25
26
23
27
Air
Recycle

PROCESS FOR CONTINUOUS SEPARATION OF GLUCOSE AND FRUCTOSE

This is a continuation of application Ser. No. 09/274,708 filed Mar. 23, 1999.

BACKGROUND OF THE INVENTION

1. Technical Field

This disclosure relates a process for producing high fructose corn syrup (HFCS), in which a mixed feed solution of glucose and fructose is obtained from the isomerization tower. It employs as a subsequent unit operation for separating opponents of sugar mixture. More boldly, this process is used for the continuous separation of the glucose and fructose solution mixtures to retrieve various grades of glucose and fructose solution mixture and to elevate the concentration level of the separated fraction. Yet, when this process compares with traditional chromatographic process. It has its ultimate object to consume much less resin inventory and eluent water to gain the ultimate purity and higher concentration of glucose and fructose component with ultimate yield and lower production cost.

2. The Description of Prior Art

It is known that the process currently been used for separating the solution mixtures of glucose and fructose is by inputting the feed solution through a cation exchange chromatographic column then by introducing the de-ionized water to elute the dissolved components through which the separation is obtained. As taught by U.S. Pat. No. 3,044,904, U.S. Pat. No. 4,472,203, U.S. Pat. No. 4,395,292, Japanese Pat. No. 24,807 of 1970, and many other unlisted disclosures, without exception, single fixed bed chromatography is the basic mechanical device along with resembling mass transfer mechanism been used in those publications. The separation is carried out within a typical long and tall column packed with stationary resin. They are all fallen into some category of mass transfer phenomena that occurs within so called the mass transfer zone in which the eluent water is in conjunction with feed. As such zone is being transported by continuous introducing the eluent water pushing behind the feed solution, the fructose is retained by the resin to a greater degree than glucose through which the separation is achieved. At any instance of chromatographic operation, the contributed resin for separation is only when such zone passed by and the remaining are idle. Note that the so-called the displacement zone is always existed as eluent water pushing off previous feed introducing through resin bed to proceed separation. As various methods and processes being developed upon said mass transfer mechanism in chromatography, the column process has been long recognized and implemented as standard equipment that inherent with shortcomings. Such fundamental mass transfer mechanism has not been further improved through using same resin and eluent in much less inventory and yet gaining better separation. Those imperfections are multifaceted coexisted and affecting one another, which are briefly illustrated as following:

Inefficient usage of resin, the mass transfer proceeded only at the very front of mass transfer zone, the resin before and after such zone are idle;

Due to exist of displacement zone to create excess dilution and to increase cycle time thus enhancing inefficient usage of resin;

Engineering drawbacks of column process; listed as following;

1. Flow dynamics: axial dispersion and diffusion effects are important in affecting separation quality, include back mixing of column and effects.

2. Column geometry: in and out, column end-effects includes dead volume.
3. Loading limitation: to avoid peak broadening, overlapping and tailing due flow-dynamics.

Require long cycle time to further weaken economic consumption of resin and eluent, to intensify said engineering drawbacks; and Require long cycle time to further weaken economic consumption of resin and eluent, to intensify said engineering drawback; and High-pressure drop and difficulty in maintenance.

An improved simulated moving bed process, abbreviated as SMB, is taught in both Japanese Provisional Patent Publication No. 26336 of 1978 in which zeolite is used as resin and Japanese Provisional Patent Publication No. 88355 of 1978 in which a cation exchange resin is used. In those later becomes well accepted as industrial process for glucose and fructose separation. The process compromises multiple columns connected in series, each column has its distributors to allow fluid to flow into and out of such column. Actually, each column in such series connection represents a particular mass-transfer task compared to a long column to carry out all tasks in sequence. At a setting time interval, all points of feed loading, eluent introducing, product and by-product withdrawals are shifted simultaneously purposely for cutting down resin consumption. Unlike rapid virtue of high ion mobility and electrical actions in water ion exchange reactions, the glucose and fructose separations are very slow. These sugars are non-electrolytes and their separation is governed by a very narrow difference interaction between sugar components and resin. An additional factor in affecting such interaction difference is water content within the mobile phase, it eliminates such interaction to minimal when too much water exists due sugars are very soluble in water. Despite various difficult natures, the general practice of SMB process operates at a flow rate of 0.8 to 1.0 bed-volume per hour for achieving separation based on small interaction difference between sugar components and resin. In the other words, the process takes 1 to 1.25 hours to complete a separation cycle. Nevertheleess, the loading limitation is set at 0.05 to 0.1 feed rate to resin bed volume ratio as the operating guideline to obtain acceptable separation quality versus operation efficiency. For example, a feed input rate of 200 balloons per minute will consume 2000 balloons of resin per minute based on 0.1 ratio. For a 1 to 1.25 hours cycle process, it will consume 120,000 to 150,000 gallons of resin. In viewpoints of excess resin being used in chromatographic process, excess eluent has to be coped in order to push off the separated fractions. It surprisingly consumes about two times of eluent water as feed input rate. Overall speaking, the SMB process is far superior to a single fixed bed process in aspects of resin consumption, operation efficiency, product yield and quality. Therefore, it has been overwhelmingly adopted as the standard industrial process ever since first introduced. However, this process is limited by using chromatography with attempting in manipulating the column configuration and optimized in fluid distribution, in which the process yet inherits the aforementioned native drawbacks of column operation.

SUMMARY OF THE INVENTION

In view of the foregoing shortcomings in applying chromatography for glucose and fructose separation, it raises and essentiality to fundamentally renovate the mass transfer mechanism in chromatography. Said resin is made of by an alkaline earth metal base strongly acidic cation exchanger resin. Concisely illustration of objects of this invention is accomplished by providing a continuous ion exchange process to simultaneously separated the feed solution into pure form of liquid glucose and fructose with 100% yield through a cutback of resin inventory. The process is completed by the integration of a new mass transfer method, a differential set-up between resin and liquid phases, an operation protocols, and an apparatus to implement all above indicated methods.

It is, therefore, a fundamental object of this invention to initiate new mass transfer method different from that observed in chromatography to eliminate the displacement zone and further utilize the void volume available for prompt mass transfer proceeding. Such said method in general is composed of at least one of following procedures.

1. Retain solid phase material in a cell having an inlet on one side and an outlet on another size with bottom meshed filter to contain said material from being drained.
2. Intermittently deliver predetermined amounts of liquid material to either promoting adsorption of dissolved components onto said material or solution of adsorbed components from said material.
3. Intermittenly supply pressurized gas to the cell on the one side following each delivery of a liquid to force prompt draining of delivered liquid said material to complete expected mass transfer between two phases.
4. Maintain a vacuum on the other side of said material to maintain said material is semi-fry status.
5. Intermittenly collecting most of treated solution from the outlet of cell.
6. Total time spent from 2 to step 5 is defined as minimal time interval.

As apparatus installed with said resin installed in chromatography carries out such indicated methods. The apparatus is composed of a circular plate disposed vertically to a centered driven shaft. A plurality of partially fluidize beds, named as cell thereafter, having each cell with top opening to receive the fluid and bottom fiber to retain said resin from being drained. All cells, arranged in at least one circular roll in equal space, are installed into respective hole on said circular plate concentrically along the driven shaft. Said cells are covered over with a flattop annular channel equipped with constant temperature heating jacket and insulation . All cells are grouped into predetermined number of cell for specific liquid delivery. The plate and all cells rotate concentrically along the shaft and position by means of rotation and stop mechanism at a predetermined angle as one advance rotation step. Predetermined amount of all liquids, including feed solution, eluent water, and recycled streams from predetermined holding tank is intermittently delivered into respective cell via a showerhead to sprinkle a wetted region of retained resin. Such delivered liquid is instantaneously settled and drained by pressured air and all cells rotate concentrically along the shaft and position by means for rotation and stop mechanism at a predetermined angle as one advance rotation step. Predetermined amount of all liquids, including feed solution, eluent water, and recycled streams from predetermined holding tank is intermittently delivered into respective cell via a showerhead to sprinkle a wetted region of retained resin. Such delivered liquid is instantaneously settled and drained by pressure air applied from top of cell and vacuum exerted from bottom of cell to maintain resin at semi-dry status. The whole time, the drained liquid from cells is collected through partitioned curved chamber located beneath said circular plate to prevent drained liquid from being mixed with each other. The collected liquid flows into each corresponding holding tank underneath such zone. The whole time, the exit air from apparatus is passing through a jacket condenser to condense the water vapor before entering a vacuum pump. Then, the apparatus advances further on rotation step by means of rotation mechanism before next dose of liquid input. During steady stage operation, the apparatus repeats repeatedly for all cells in different zones simultaneously with liquid filling, liquid draining and collected through said means within every spent of said minimal time interval.

It is an object of the invention to maximize the utilization of resin installed in each cell. The amount of resin installed in each cell is equivalent to resin of mass transfer zone (abbreviated as MTZ) in traditional chromatography. It means the resin installed in loading zone is completely saturated with feed solution. In chromatography, this MTZ is the resin been saturated with feed in about 5 to 10% of bed volume and transported by eluent from one end to exit from other end of column.

More specifically, it is an objected of the invention to established differential set-up protocols among all kinds of solutions to interact with retained resin in a cell to efficiently reduce cycle time compared with chromatography. Briefly, characterized thereafter are methods for said protocols by obtaining a characteristic elution profile from a single cell testing through sequentially and intermittently delivering predetermined amount of said all liquids via said new mass transfer method. Break down said profile with each partial time required for respective solution. Divide each partial time by said minimal time interval to obtain the number of steps for such zone. Then, divides the volume of such liquid by the number of steps to obtain the partial volume required for each step. Further divides both said resin, which derived from complete saturation with feed solution, and partial volume of such liquid by a pre-selected number that corresponds to a group of cells at each step to simultaneously receive the partial volume of such liquid for each cell in said group of cells. Sequentially allocate all cells with respective solution at the range of respective zone and allocated all zones into an endless format. Prepare predetermined volume of respective solution to store in a holding tank for distribution. For simultaneous deliver of various fluids into respective zone during steady state operation in said apparatus, by which it transforms the traditional chromatographic separation path from parallel into vertical with mobile phase'a flow direction. At any instance of steady state operation, a complete separation cycle is accomplished after every spent of minimal time interval.

It is a further object of this invention to establish single state recycle protocols onto said apparatus to simultaneously proceed continuous separation and concentration enhancement of fractionated mixtures to cut down eluent water consumption. Still recycling protolcs simultaneously input streams of feed solution and eluent water, and other recycled across the predetermined input streams of feed solution and eluent water, and other recycled streams from predetermined holding tank into predetermined zone. Each zone is independent from each other and yet is communicating through each respective holding tank. Consequentially, this disclosure separates a food stream continuously into two streams each in 100% yield of pure composition of glucose and fructose in feed; and a multiplicity of recycling streams in stable composition and concentration of glucose and fructose mixture;

BRIEF DESCRIPTION OF THE DRAWINGS

The above and other objects, distinct features and merits of the present invention can be more readily explained from the following illustrations, taken with drawings in which.

DETAILED DSCRIPTION OF THE PREFERRED EMBODIENTS

Figure 6:
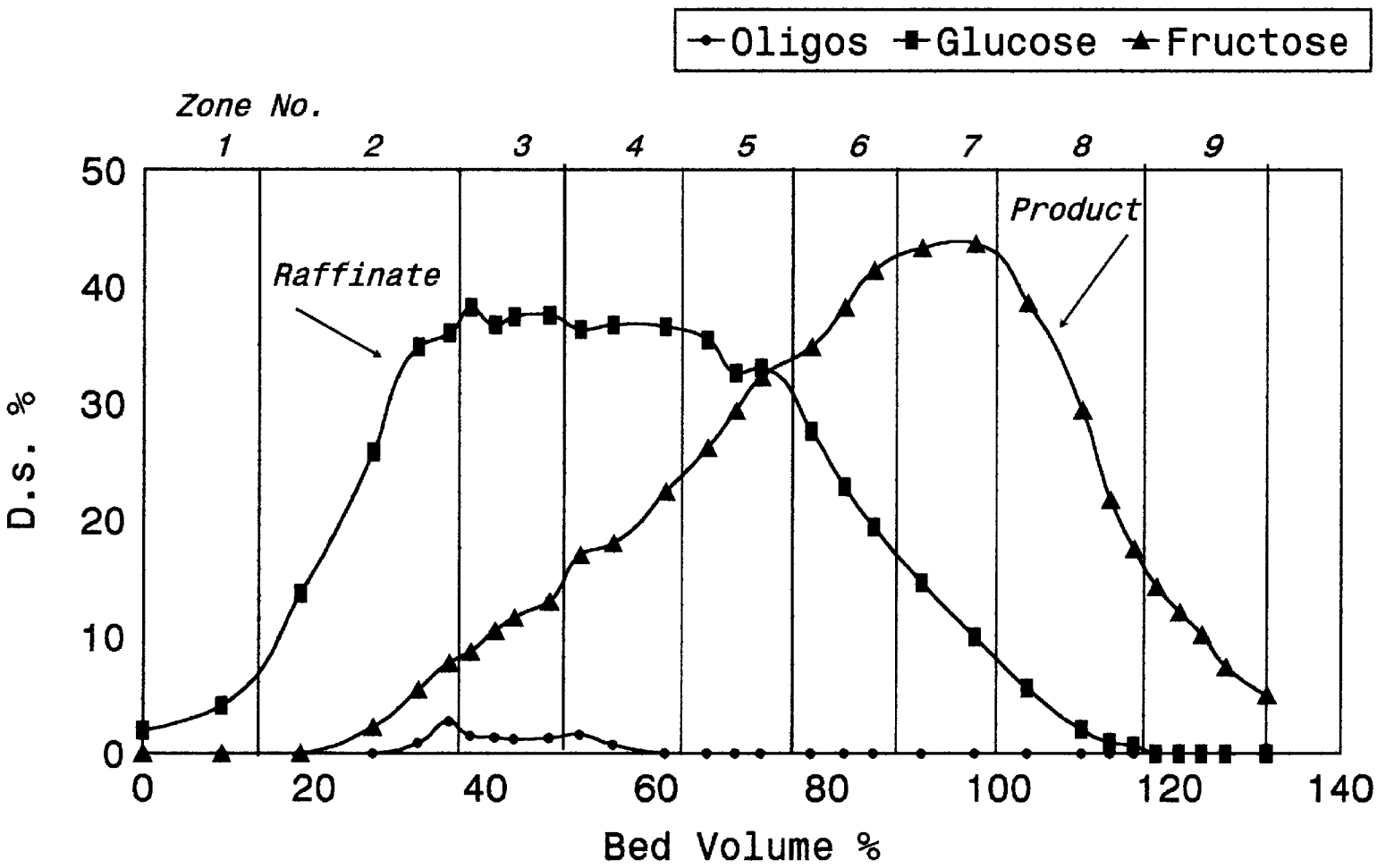

FIG. 6 through FIG. 10 are the steady state elution profiles of six consecutive cycles constructed by addition of raffinate zone and a product zone into a current cycle wherein the composition of said zones are predetermined from the retrieved raffinate and product stream of previous cycle; and wherein FIG. 6 stands for a 8 zone 15 for elevated concentration.

DETAILED DESCRIPTION OF THE PREFERRED EMBODIMENTS

Figure 2:
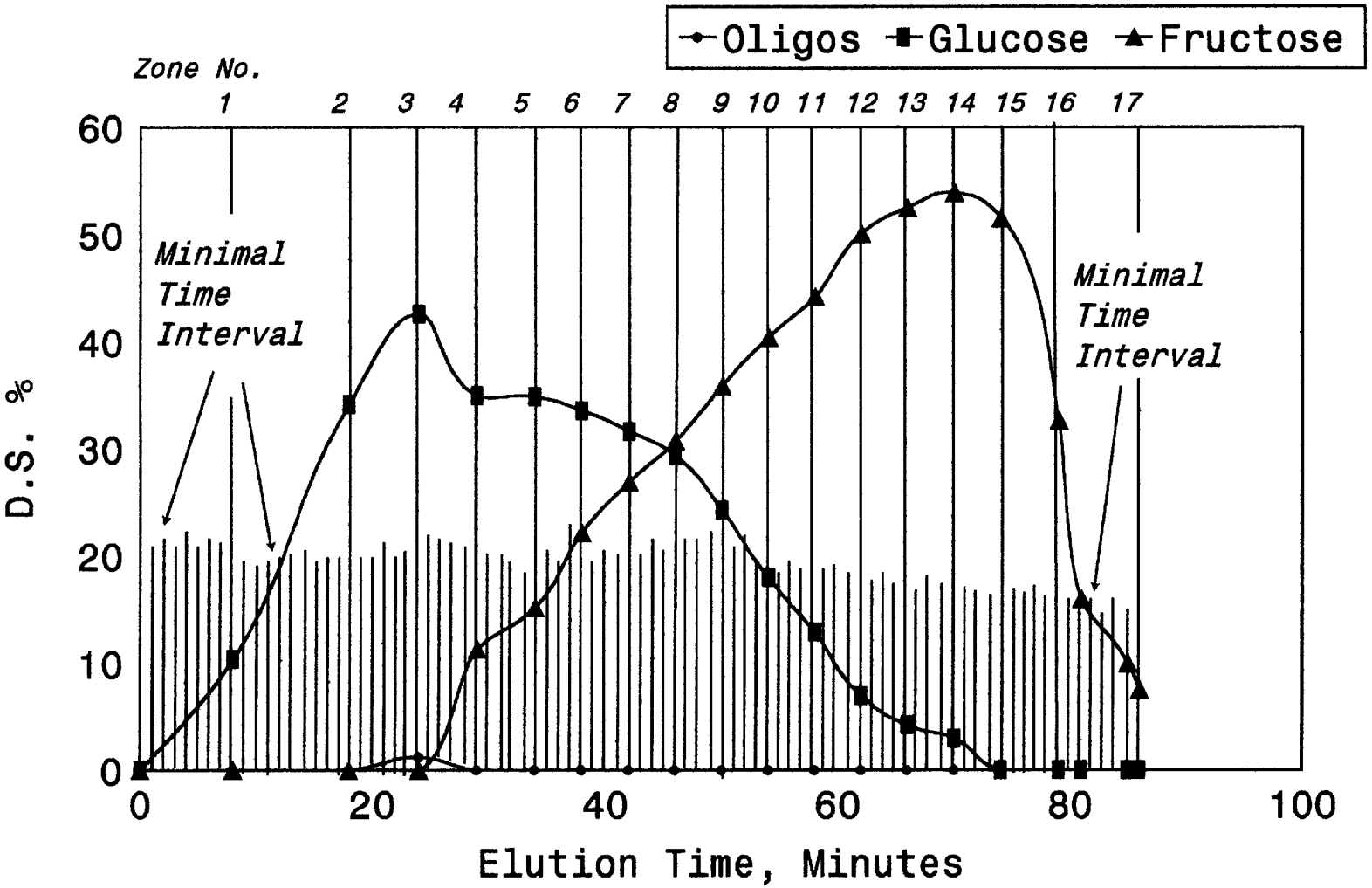
FIG. 2 shows the concentration profile from a single cell testing of 17-zones protocols in which the glucose, fructose, and oligosaccharides are plotted as D.S. % vs. elution time, and wherein the pure glucose and frucose stream are recovered from a feed stream.
Figure 3:
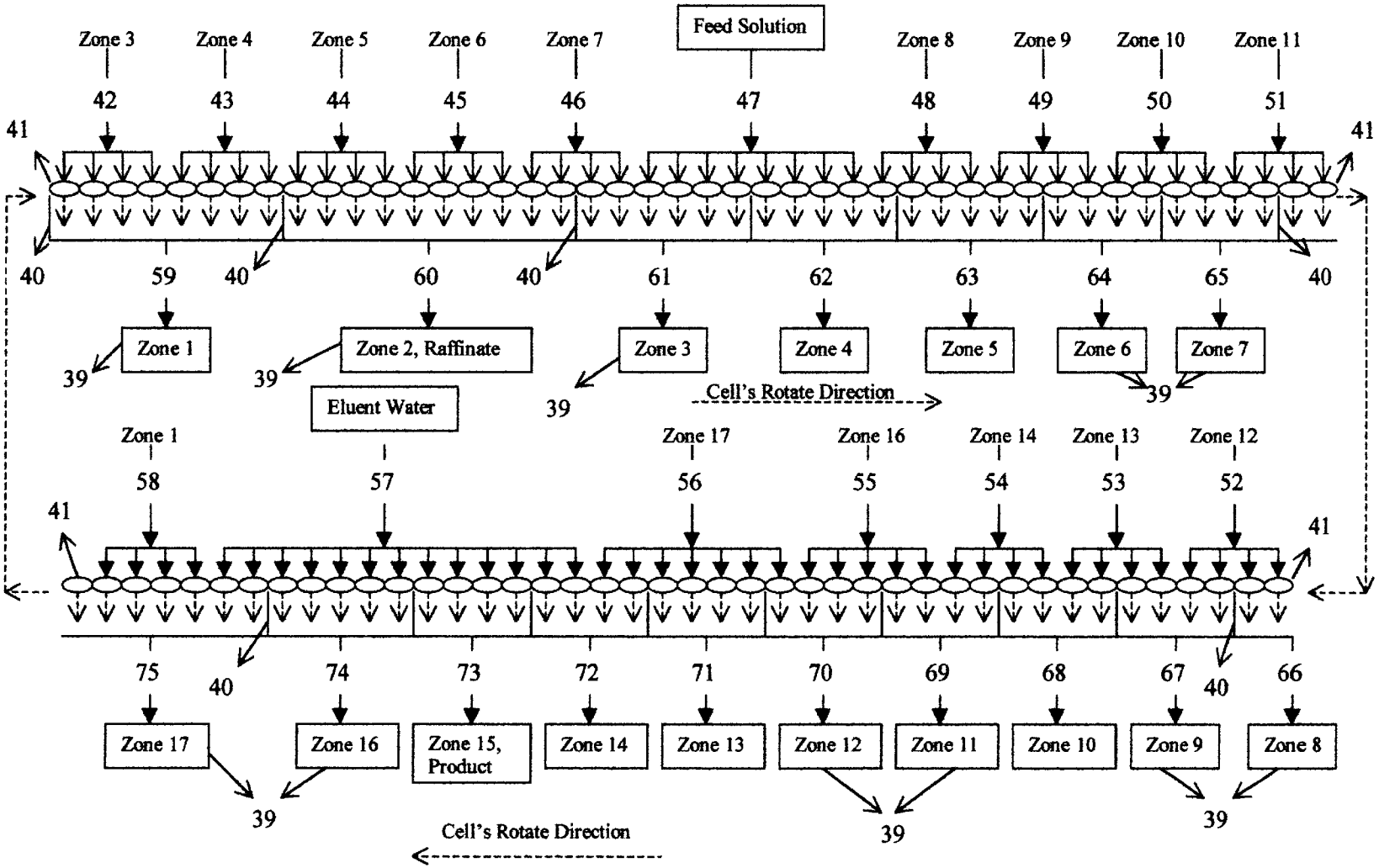
FIG. 3 is the schematic diagram for converting the elution profiles of FIG. 2 into a single-stage recycle process.

The present invention relates to a continuous process for separating mixture solution of glucose, fructose, and oligosaccharide from a feed solution containing the same. This process is carried out in an apparatus to incorporate with new mass transfer method, differential set-up between solid and liquid phase, and recycle protocols, which are integrated as hybrid embodiment and named as SSP. This broad and generalized SSP is illustrated in co-pending application, named as "Differential and Continuous Separation Process with Controlled Parameters for Solids and Liquids", which is filed separately. The pending application and current disclosure are therefore characterizeed as each other'a citation. Yet, the significance of SSP over chromatography is further sustained through this application. Three preferred embodiments of the current disclosure will be illustrated hereafter namely onto said apparatus for a continuous is further sustained through this application. Three preferred embodiments of the current disclosure will be illustrated hereafter namely as the apparatus shown in FIG. 2. Demonstrated in FIGS. 2 and 3 are employed onto said apparatus for a continuous separation of recovering pure glucose and fructose stream from a feed stream. In addition, FIGS. 4 through 10 are examples illustrated for procedures obtaining the results shown in FIG. 2 proceeded under said new mass transfer method.

The bonding capacity measurement of semi-dry status resin is fundamental prior to the application of SSP, wherein the resin is first washed with de-ionized water and followed to treat with vacuum for removing excess water between grains of resin. Said measurement is achieved by adding fixed increment of resin to a prefixed volume of feed solution to promote adsorption of sugar components onto the resin. The total amount of resin consumed in resin capacity measurement is the optimal amount can be proportionally increase with the process throughput for mass production scale. In fact, the predetermined amount of resin is equivalent to that in mass transfer zone (MTZ) of a chromatographic operation. Such optimal quantity of resin is installed in each cell disposed in the apparatus wherein said cell having an inlet on one side and an outlet on another side with bottom meshed filter to contain said material from being drained.

In chromatographic operation, the MTZ is moving along with fluid stream by inputting additional mobile phase to push off such zone from one end toward other end of column. The time spent is known as displacement zone, wherein the stationary resin is constantly maintained at wet status. The mass transfer is proceeded as the mobile phase pass by the stationary resin. Unlike chromatographic operation, this invention is to initiate a new mass transfer method to further utilize the void volume available for prompt mass transfer proceeding by eliminating such displacement zone and maintaining resin in a semi-dry status. Said method is composed of following general procedures:

1. Retain solid phase material in a said cell, of which the amount is equivalent to MTZ in chromatography; the inlet of cell is from top and the outer of cell is from bottom.
2. Intermittently deliver predetermined amounts of mobile phase material to either promoting adsorption of dissolved components onto said resin or elution of adsorbed components from said resin.
3. Intermittently supply pressurized gas to the cell on the one side following each delivery of a mobile phase material to force prompt draining such mobile phase through said solid phase material to complete expected mass transfer between two phases.
4. Maintain a vacuum on the other side of said solid phase material to maintain it in a semi-dry status.
5. Intermittently collect of most of treated mobile phase material from the outlet of cell.

Total time spent from step 2 to step 5 is defined as minimal time interval, $\Delta t$. Overall, the mechanism of mass transfer between two phases and the means of mobile phase delivery are different from those in chromatography. In the event, for separation of glucose and fructose, the above-indicated step 2 is proceeded by input S-I mode. It means all mobile phases including feed solution, eluent water and recycle streams from various zones, of which conditions remains unchanged, as step input. The total volume of such mobile phase is subdivided into several predetermined doses and simultaneously delivered as impulse input within a shortest time domain into all cells disposed in specific zone by each said minimal time interval is spent. The step 3 and step 4 of vacuum and/or pressurized air immediately push off the delivered liquid. Such liquid is delivered via a showerhead to sprinkling onto the resin to form a partially wetted region for instantaneous and heterogeneous mass transfer contact between the drained liquid collected in step 5 and said resin.

Figure 1:
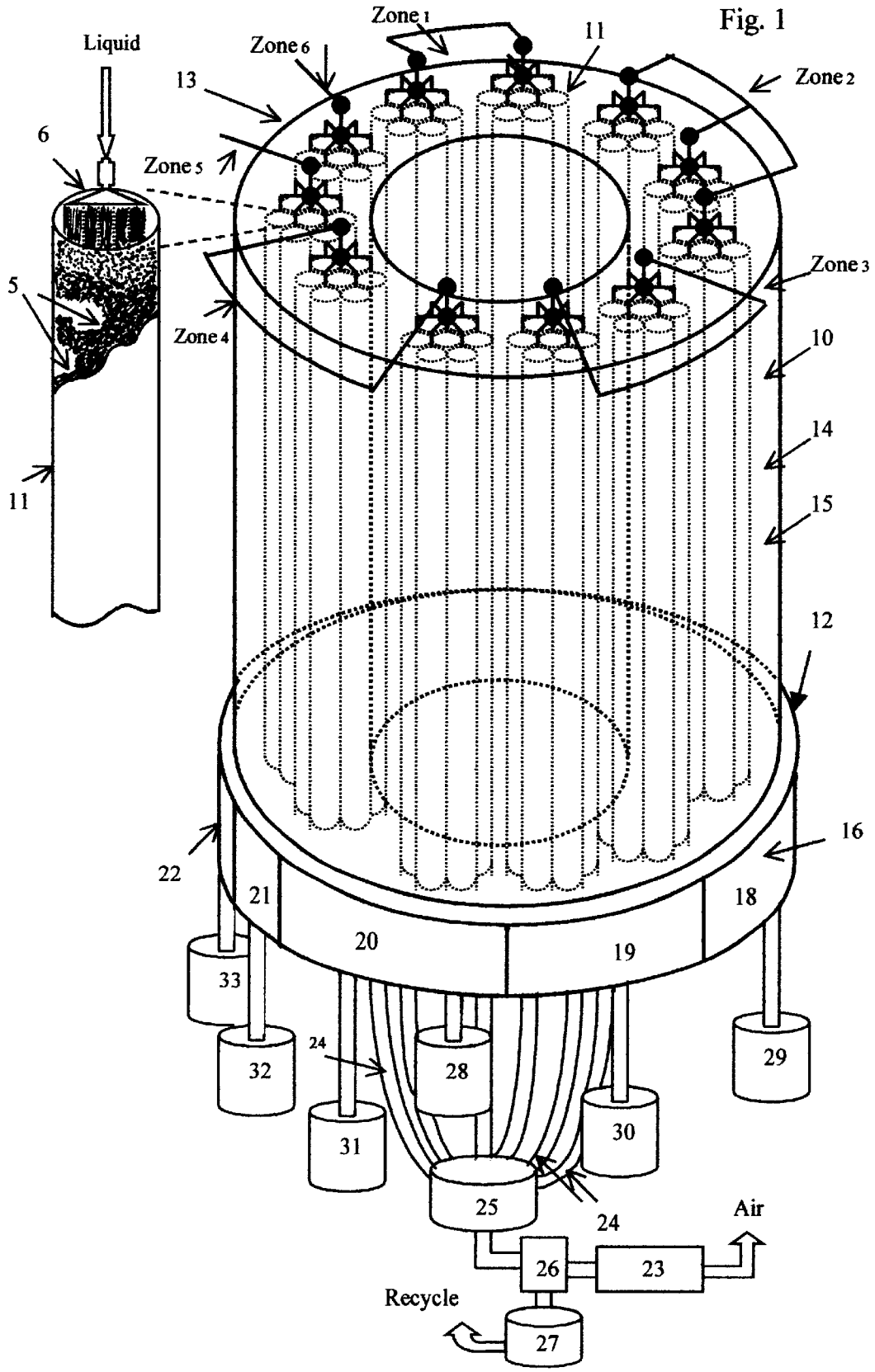
FIG. 1 is a perspective view of preferred apparatus for the separation of said sugar mixture.

FIG. 1 is composed as the preferred version of apparatus 10 to better suit for the separation of glucose and fructose. The detailed and general illustration of apparatus itself is fully described in the above-cited application. For sake of simplicity in drawing, a six-zone apparatus repents the preferred device for glucose and fructose separation. Each rotation step is represented by a group of selected seven sub-cells 11, denoted by dotted line. The pluralities of cells 11 are mounted with respective holes (not shown) and spaced equally on a rotative circular plate 12 and centered along the central shaft (not shown). All cells are covered over by a flattop annular compartment 13 equipped with constant temperatures heating jacket 14 and insulation 15, not shown in detail for simplicity in drawing. The preferred sub-cell 11 is a circular cylinder, having a bottom filter to retain the resin 5 from been drained and a top opening. The predetermined amount of filter is intermittently delivered through a showerhead 6 to from a partial wetted region of said resin. The said resin installed in each cell is calcium base strongly acidic cation exchanger produced by several resin suppliers. Said stationary showerhead 6 are mounted on the interior side of compartment 13. Each center of cell'a inlet is lined up with respective showerhead 6 via means of rotation and positioning mechanism to intermittently receiving predetermined amount of liquid. The means for liquid delivery and means for pressurized air, detailed not shown for simplified drawing, are mounted on the exterior side of compartment 13. A circular trough like the one curved segmental chamber 16 is positioned for collecting and not to mixing the drained fluid from different zones. The zone chamber compartments are 17 (now shown), 18, 19, 20, 21, and 22, each corresponding to zone 1 through zone 6. The liquid draining are mainly produced in part by a central vacuum pump 23 and in part by pressurized air to continously drain off liquid from cells. The air is pulled evenly from inner wall of chamber 16 via pipelines 24 through air manifold 25, through water cooling-jacket 26 to exit via said pump 23. The condensed moisture is collected via holding tank 27 and reused in water supply. There are total six holding tanks 28, 29, 30, 31, 32, and 33 located underneath each corresponding chamber compartments 17 through 22, purposely for temporary storage of collected liquids from various zones and redistributed for further applications.

The apparatus proceed the operation through the said start-up stage in cited application and move forward into steady-state stage operation. The whole time, central vacuum pump 23 is engaged to continously drain the liquid and maintain resin in semi-dry status to meet criterion of new mass transfer method. The whole time, the exit air leaving from the apparatus passes through the water-cooled condensing jacket to condense water moisture for reusing before entering the vacuum pump. All cells 11 installed in the apparatus simultaneously receive various fluids via showerhead 6 to partially wet the resin 5 and create a heterogeneous contact as dreained liquid through stationary resin particles. Soon after the predetermined volume of liquid inputting is satisfied, the liquid delivery is shut-off and pressure aid is released to affiliate the liquid draining and resin return to semi-dry status before the next liquid input. The whole time, drainged liquids are gathered from various zones through partitioned curved chambers and flow into each corresponding holding tanks via a valve disposed in the connection (now shown) underneath such zone. Simultaneously apparatus engage the means of rotation and positioning mechanism to rotate all cells 11 and plate 12 by a predetermined rotation angle before next groups of liquid input. The apparatus repeats repeatedly during the course of steady state stage operation for simultaneously inputting, liquid draining, liquid collecting and rotating one step forward in a predetermined direction.

Prior to implementation of differential set-up between two phases onto the apparatus, a preliminary test is required from a single cell. It starts from sequentially inputting all kinds of predetermined solution mixtures via said general procedures of new mass transfer method. A preferable 17-zones steady state test is shown in FIG. 2, wherein the glucose, fructose, and oligosaccharide concentration are plotted as D.S. % (dry solid percentage) in Y-axis vs. elution time in X-axis. The method derived for obtaining the result shown in FIG. 2 will be illustrated later in examples of FIG. 4 through FIG. 10. The steady state means the concentration and the composition of glucose and fructose mixture of respective zone showing little difference among repeated testing. The testing is proceeded by each increment of minimal time interval as one minute. By the nature of said new mass transfer method, the input of liquid is promptly been drained by said vacuum and pressurized air. The expected mass transfer phenomena has been executed as delivered liquid been drained through the resin. The concentration and composition of treated solution collected from bottom of such cell representing a complete separation cycle. Unlike typical chromatographic elution profile having displacement zone than eluted profile, said new mass transfer method has such profile starting from the beginning of elution time. Through such method, the displacement zone in traditional chromatographic operation has been eliminated and so is the void volume available between resin grains is been utilized for separation. Comparing with traditional chromatography, this saving in cycle time translates a saving of resin consumption. The preferable 17-zones protocols implemented onto the apparatus is capable to continuously recover a raffinate of pure glucose from zone 2 in concentration ranging from zone 2 in concentration ranging between 30.0 to 40.0 D.S. % and a product of pure fructose from zone 15 ranging in between 50.0 to 58 D.S. % of elevated concentration. The total cycle time incurred from sequential liquid delivery into said cell, including feed, eluent water, and recycled solutions, and to collecting solution from bottom of cell form zone 1 through zone 17, is 86 minutes.

Actually, there is no specific preference in setting up said number of group cells or number of rotation steps or predetermined time interval in one revolution of apparatus. It solely depends on the total time require to spent for completing one elution profile divided by the said predetermined minimal time interval, such that to simplify the procedures to minimal complexity to obtain best separation results. In any event, therefore, other alternatives protocols may be established, yet, such alternations should be confined within the scope of this disclosure. The general method of different set-up between solid phase material and mobile phases is composed the following procedures.

1. Sequentially break down the elution profile obtained by said new mass transfer method as demonstrated in FIG. 2 to obtain the partial time required for each respective mobile phase, including feed, eluent water, and recycled streams.
2. Divide respective partial time by a predetermined minimal time interval to obtain the number of steps for such zone and divide the volume of such mobile phase by the number of steps to obtain the partial volume required for each step. Further divide both resin used in any one step and said partial volume of such mobile phase by a pre-selected number that represents a group of sub-cells in one step to simultaneously receive the partial or partial volume of such mobile phase for each sub-cell containing partial amount of said resin in said group of sub-cells.
3. Allocate all cells with respective mobile phase in step 2 to be the range for respective zone, this includes solution of feed, eluent water, and all recycled streams.

4. Arrange all zones sequentially in an endless circular format representing a complete separation cycle.

FIG. 3 exemplifies said differential set-up protocols onto said apparatus for input of various liquids and its output distribution thereafter via respective holding tank 39 located underneath each corresponding zone compartment. Each zone compartment has partition 40 to prevent drained liquids of various zones from mixing among others. This figure outlines such separation cycle, which is based on one minute per step or 86-steps to reflect the profile derived in FIG. 2. In fact, one minute per step is randomly chosen and it can be in multiple as another preferred minimal intervals, which is interpreted as a predetermined major step to proportionally reduce number of steps with modification of procedures. This figure further illustrates the single stage recycle protocol for elevating the concentration level of separated product. All cells 41 are simplified by an "oval" arranging in an endless circular sequence and go around with a predetermined cell's rotate direction. Apparently, the start-up step illustrated in the cited application has to be satisfied prior to the execution of steady state operation. Such start-up step is carried out through means of liquid delivery and rotation mechanism; the cell 41 initially located at fist position of zone 1 orderly moves around and stop at a current position. All cells covering a range from the first position of zone 1 to a current position of where the cell 41 is located. Within such range, all cells simultaneously receive predetermined amount of various kinds of liquid delivery proceeded as said new mass transfer method. The same procedures repeat repeatedly until the cell 41 returns to the first position of zone 1 to conclude start-up step and begin the steady state operation. During the stead state operation, following procedures are repeated repeatedly.

1. Through means of liquid delivery, a predetermined volume of various liquids from respective holding tanks 39 of zone 3, 4, 5, 6, 7, feed solution 8, 9, 10, 11, 12, 13,14,16,17), eluent water, and zone 1 are simultaneously and intermittently delivered by means of pipelined of 42, 43, 44, 45, 46, 47, 48, 49, 50, 51, 53, 54, 55, 56, 57, and 58 underneath cell's top-inlet to wet partial of contained resin in a cell.
2. Intermittently deliver through means of pressurized air supply to all cells following delivery of various liquids to force draining of delivery liquid through said resin to complete expected mass transfer contact between two phases.
3. Maintain a vacuum to drain the indivicual liquidinto respective zone compartment and to maintain resin in a semi-dry status.
4. Intermittently collect of drained liquids from respective zone compartment through means of pipeline of 59, 69, 61, 62, 63, 64, 65, 66, 67, 68, 69, 70, 71, 72, 73, 74, and 75 as indicated into respective holding tank of zone 1, 2, 3, 4, 5, 6, 7, 8, 9, 10, 11, 12, 13, 14, 15, 16, and 17, through means of wherein the solution collected from zone 2 is a raffinate and solution from zone 15 is a product.
5. Advance one rotation step through means of rotation mechanism in cell's rotating All the repeated motions are accomplished during each spent of said minimal time interval, $\Delta t$, which is covered from step 1 through step 4. Such minimal time interval specified in FIG. 2 represents the elution profiles gained from a single cell's testing. Through the implementation of new mass transfer method and said differential set-up between two phases onto the apparatus, one rotation step from the apparatus is equivalent to one separation cycle, which covers from feed loading to final elution. Nevertheless, this invention has shown that the traditional mass transfer path occurred in chromatography, typically is parallel with liquid flow direction, has been converted into perpendicularity with flow direction. The feed solution is introduced via line 47 located in between recycled stream of zone 7 and zone 8, wherein feed solution has glucose content slightly lower than that in zone 7 and slightly higher than that in zone 8. The component of glucose and fructose originally contained in the feed solution is thus migrating horizontally through recycle streams toward zone 2 recovered as a raffinate stream of pure glucose via line 60, and toward zone 15 recovered as a product stream of pure fructose via line 73. Furthermore, the traditional chromatography speeds extra time for pushing of displacement zone, in which the separated component is travelling with bulk liquid flow. This invention has demonstrated the elimination of such displacement zone and therefore the cycle time is dramatically reduced, thus, the resin inventory, liquid phase consumption, and other unspecified operation cost can be diminished proportionally.

As earlier illustration of resin installed in each cell of apparatus is the like amount of MTZ in chromatographic operation, which is directly related to the maximum bonding capacity of resin in a semi-dry condition. Under this foregoing guideline of new mass transfer method, the bonding capacity is irrelevant to concentration of sugars mixture in feed solution 9(D.S.%) but is mattered with the absolute weight of bonded sugars vs. Resin s boning capacity. Thus, the feed solution can be input ranging from as low as 10 to high as 70 D.S. %. In this invention, the 60 D.S. % is selected for demonstration and predetermined condition in single cell experimental testing due 60 D.S. % is most popular in SMB process. In general, the higher the concentration of D.S. % in feed solution is preferably simply because less in volume to handle.

Under the same foregone guideline, the amount of de-ionized water consumed becomes irrelevant to its fluid kinetics; including fluid dynamics, flow rate, and flow pattern that are extremely critical in chromatographic operation. Because the separation parameters of target system are derived directly from the predetermined elution profiles, which are then well implemented by the apparatus. The amount of eluent consumption is directly related to how fast the elution can be competed, it meas how fast the apparatus can manage the various fluids in a most prompt and efficient manner to achieve the elution within a least spent time. Apparently, this water consumption is calculated and obtained directly from experimental testing proceeded under new mass transfer weight of sugars loaded in such resin. Note that the recovered water from exit vacuum air in condensing unit can be reused, which can be deduced from total washer consumption.

In appreciation of new mass transfer method, the inter-resin particle fluid is removed by vacuum to constantly maintain resin at semi-dry status. Traditional issues in chromatographic operation, such as resin's mesh size related to pressure loss, and related mass transfer resistance to access adsorption sites in porous resin are not very important in present invention. Simply because the removal of fluid is between resin particle by vacuum exposes the area available for mass transfer to maximum thus allowing the adsorption and elution to proceed in a most efficient manner. A type of resin, calcium base strongly acidic cation exchanger with mean particle size of 320 $\mu$m±10 $\mu$m, been broadly adopted in most industrial SMB process is chosen in this invention.

It is intentionally employed for the comparison between this invention and traditional process in term of resin and eluent consumption. In general, it is preferable in using smaller mesh size of resin particle to possess larger available mass transfer contact area, because the pressure loss is less critical in this invention. The operation temperature is preferable in range of 60° to 85° C. to prevent microorganism growth in the apparatus and reduces the viscosity for easy flow of sugar solution in recycling procedures.

The objects and protocols of this invention can be readily comprehended from the following examples, tables, and resin inventory calculated for a specified throughput for the said process. To avoid repeated illustration in examples, the specifications of primary components are listed as following.

Feed solution: High Fructose Corn Syrup received from domestic corn refiner, having composition of Fructose 43.05%, Glucose 51.09%, and balance of Oligos, with concentration of 71.1% dry substance. This material is diluted with de-ionized water to 60% dry substance.

Resin: Dowex Monosphere 99, Calcium base strongly acidic cation exchanger with mean particle size of 320 $\mu$m±10 $\mu$m.

The said feed solution and resin are investigated by single cell testing, through which to demonstrate the distinction of mass transfer phenomena between this disclosure and the chromatography. The cell dimension is 1.27 cm in I.D. and 203.2 cm in bed height and jacked with 65° C. water circulation. The resin is filled in bed with total 190.5 cm in height and 241 cc in bed volume. Unlike chromatography, the resin is saturated with water. The new mass transfer method is proceeded under 27 inch-Hg vacuum applied from bottom of bed to continuously drain off the inter-particle's fluid. The reservoirs of feed, recycled streams, and eluent water are jacketed with 65° C. water circulation. All liquid inputs are simulated by a quick stroke of liquid pipette to deliver the predetermined volume of such liquid in a form of said input S-I. The bottom of bed is equipped with an airtight easy thread on and off bottle for sample collection by every prearranged time interval, which is said minimal time interval. The vapor recovery unit jacketed with circulated cold water is installed in between the bed and vacuum pump, and the condensed water will be collected from bottle installed under such condenser. In between each dose of liquid delivery, the pressurized air is supplied from top of cell to affiliate with vacuum for fast liquid draining. Those experimental features are actually set in accordance with the preferred apparatus as shown in FIG. 1.

EXAMPLE 1

Figure 4:
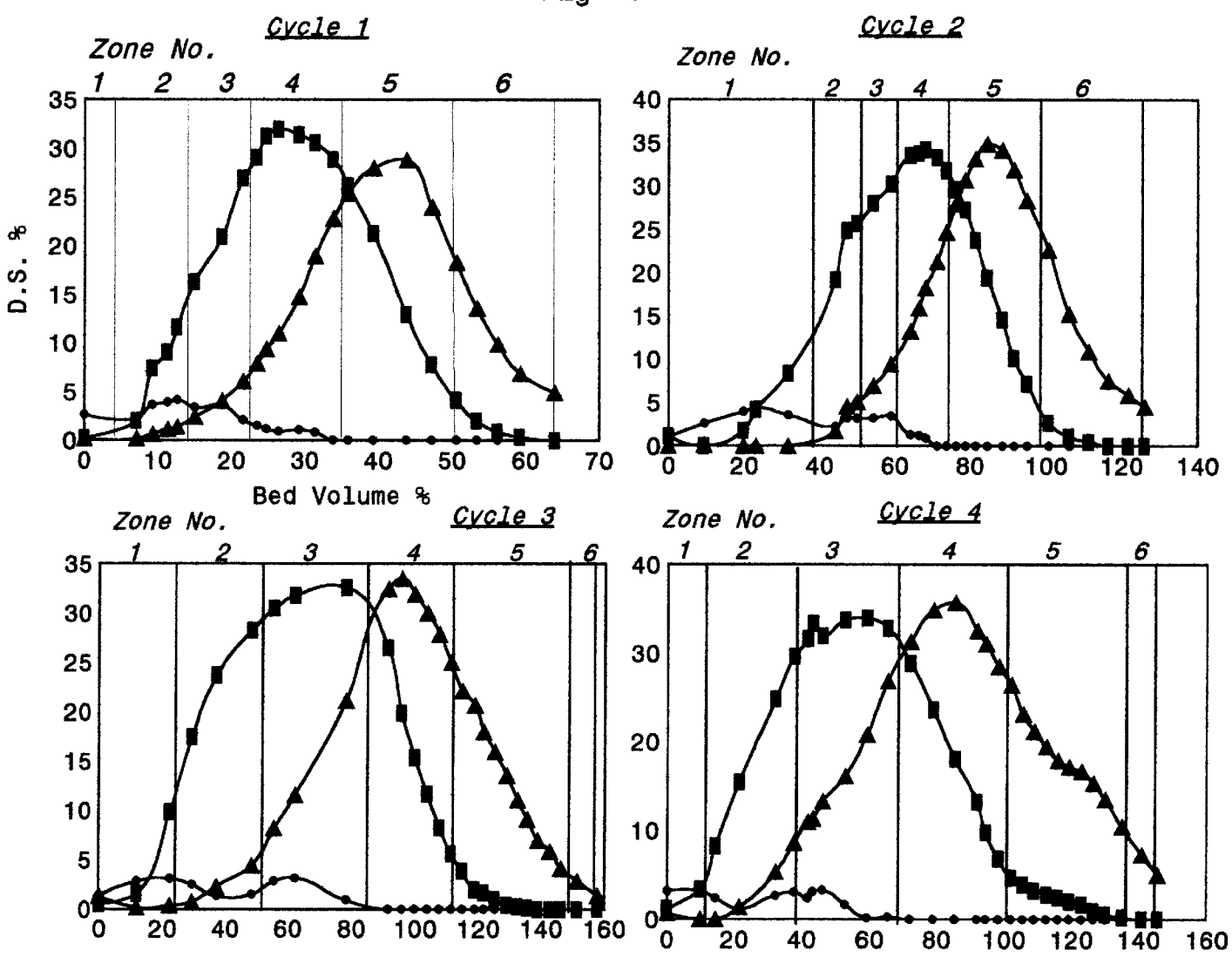
FIG. 4 is the elution profiles of cycle 1 through cycle 4 by Input S-I at 0.25 of feed to bed volume ratio wherein the steady state is obtained at cycle 4.

The FIG. 4 shows the characteristic profile of four cycles proceeded under new mass transfer method, in which each cycle's sample concentration is plotted on Y-axis as D.S. % vs. accumulated sample volume converted as Bed Volume % on X-axis. Cycle 1 has 60 cc (25% of bed volume) of feed input via a 2.5 cc/dose every 10 seconds per minute for 4 minutes. Total 24.8 cc of water is collected as sample #1 with majority of oligos originally existed in feed solution. This phenomenon has not been realized in traditional chromatography, mainly because the column is saturated with water and additional water will cause the bounded sugars to immediately return to surrounding mobile phase. Nevertheless, the major distinction between this disclosure and traditional chromatography is apparent in aspect of resin's adsorption capacity, through which enables resin to increase it's bonding capacity many folds. This tremendous advantage benefited from said new mass transfer method would be illustrated in following examples of multiple zones, single stage recycle products.

The solution collected from sample #1 is zone 1. The water elution is proceeded after feed input by three formats of input S-I and samples are collected. The first input format covers each water dose delivered is 0.1 cc by each 20 seconds interval for total 3 doses in every repeated one minute interval. For simple notation, the format of input S-I can be denoted as ((1.0 cc/20 sec.)*3/min). The total water input is 3 cc per minute interval. The second format is ((1.0 cc/10 sec.)*6min.), which is 6 cc per minute interval for six doses of 1 cc for every 10 seconds. The third format is ((1.5 cc/10 sec.)*6/min), which is 9 cc per minute interval for six does of 1.5 cc per 10 seconds. Details combinations of input format hereinafter are omitted to simplify illustration. Mainly, the eluent input is adjusted in a way that to elute most of glucose as front peak to prolong the fructose peak in farther apart from the glucose peak. As shown in cycle 1, collected samples are selectively combined as solutions of zone 1 through zone 6, which are retained as the input solution of next cycle. The cycle time is 30 minutes, consumed 157 cc of eluent water and 17 cc of condensed water is collected. The input of cycle 2 is proceeded in sequence of zone 2, 3, 4, and 60 cc of feed solution, then zone 5, 6, 124.8 cc of eluent water, and finally the zone 1 solution. Said feed solution is always delivered in between two zones wherein zone 4 having glucose content slightly higher than that in feed solution and zone 5 having glucose content slightly lower than that in feed solution. The cycle time is increased to 36 minutes and 21 cc of condensed water is collected. The elution profile of cycle 2 has a more pure glucose region (Zone 2) in the front peak and has a much pure fructose mixture (Zone 5) in fructose peak. Likewise, the combined samples, as solutions of zone 1 through zone 6 are retained as the input solution in cycle 3. The same sequence as those in cycle 2 is followed, which is composed of zone 2,3,4, 60 cc of feed solution, zone 5, 6, 125 cc of eluent water, and zone 1 solution. The cycle time is 36 minutes and 18 cc of condensed water is collected. Two sugars in feed solution are steadily migrating toward zone 2 as glucose enriched solution and zone 5 as fructose enriched solution. Only zone 2 solution of cycle 3 is retained as raffinate in this cycle. The remaining solutions are input for cycle 4 in sequence as zone 3, 60 cc of feed, 4, 5, 6, 90 cc of eluent water, and zone 1 solution. The cycle time is 36 minutes and 9 cc of condensed water is collected. The table 1 has listed the zone 2 solution as raffinate of glucose enriched solution and zone 5 as product of fructose enriched solution. The recovery percentage of respective sugar is defined as the weight percentage of retrieved sugar that in composition with the original pure component in part in feed solution. The percentage of respective sugar is defined as the weight of such sugar in part of total output.

TABLE 1

| Zone | Total Output | D.S. % | Recovery % | Glucose % | Fructose % |
|---|---|---|---|---|---|
| 2 | 25.7318 grams | 27.58 | 83.79% of glucose | 81.14 | 18.86 |
| 5 | 17.0599 grams | 19.41 | 81.25% of fructose | 10.74 | 89.26 |

EXAMPLE 2

Figure 5:
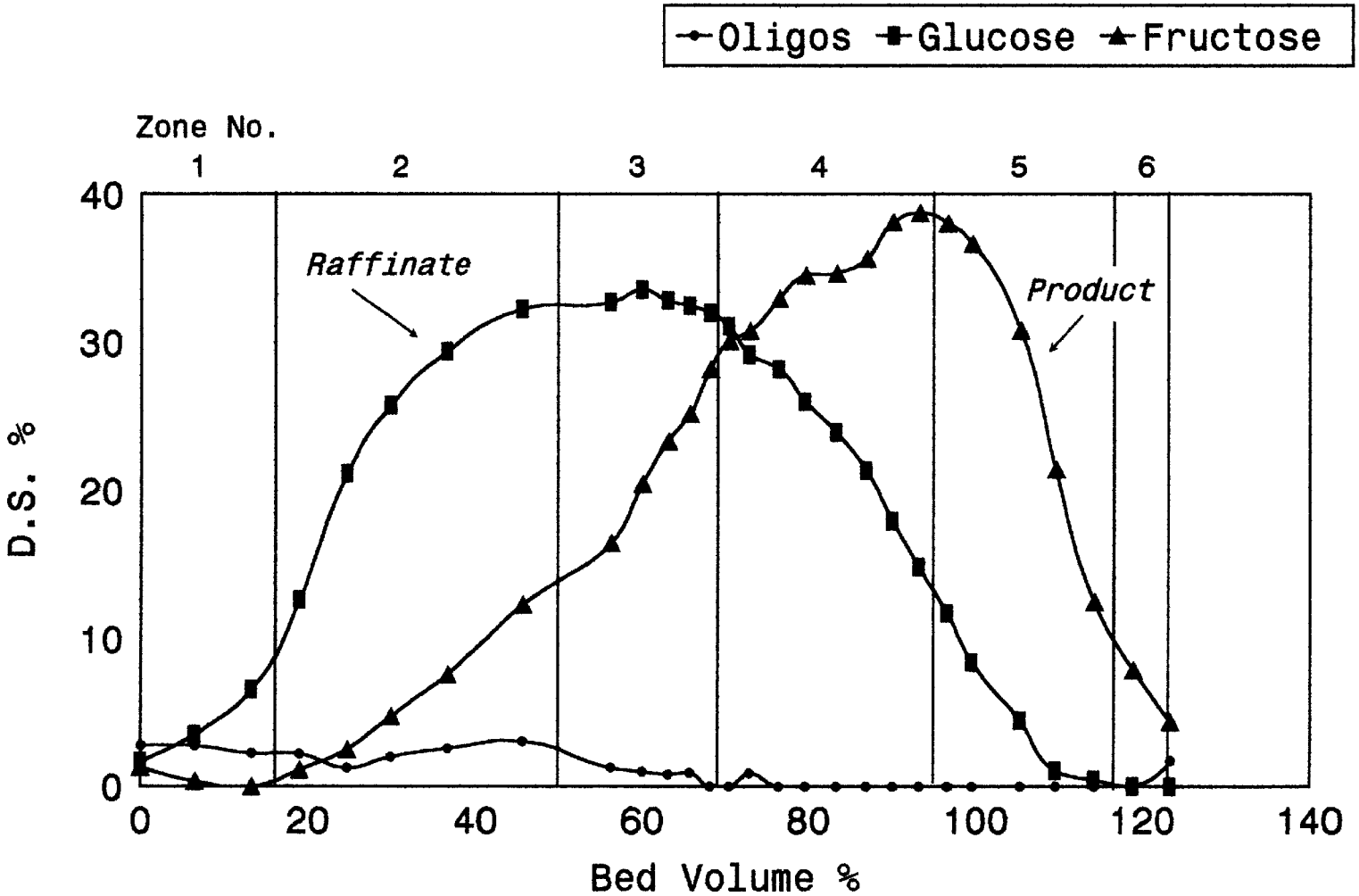
FIG. 5 represents cycle 5, a continuation of steady state of six-zones cycle from said FIG. 4, wherein a raffinate zone and a product zone into a current cycle wherein the composition of said zones are predetermined from the retrieved raffinate and product stream of previous cycle; and wherein FIG. 5 stands for a 9 zones profiles, FIG. 7 stands for 11 zones profile, FIG. 8 stands for 13 zones profiles, FIG. 9 stands for 15 zones wherein a product stream is retrieved from zone 13 of elevated concentration, FIG. 10 stands for 17 zones wherein a nearly pure product stream is retrieved from zone 15 for elevated concentration.

The elution profile shown in FIG. 5 indicates the fifth cycle extended from cycles illustrated in previous figure. The sequence of liquid input is same as those in cycle 4 except zone 5 reserved as product, which are 3, 60 cc of feed, 4, 6, 96 c of eluent water, and zone 1 solution. The cycle time is 37 minutes. Again, the solution collected from zone 2 is retained as raffinate of glucose enriched solution and the solution collected from zone 5 is retained as product of fructose enriched solution. Results are tabulated in Table 2, which demonstrates it has reached steady state that the composition and concentration are maintained constant.

TABLE 2

| Zone | Total Output | D.S. % | Recovery % | Glucose % | Fructose % |
|---|---|---|---|---|---|
| 2 | 24.3698 grams | 31.40 | 78.80% of glucose | 81.12 | 18.82 |
| 5 | 16.9526 grams | 31.20 | 86.06% of fructose | 13.8 | 86.20 |

The examples imply that the elution profile maintained steady after several cycles inasmuch as a predetermined number of zones, composition, and concentration of input liquid including feed volume, eleuent water and recycled streams are kept constant. The following examples focus on objects for establishing protocols by using necessary amount of resin, which is relevant to particular cycle time in order to obtain ultimate purity for raffinate and product and to elevate the concentration of product. The steady-state elution profit is constructed by addition of two zones in concentration ranging in between 40 to 60 D.S. % into the current profile wherein the composition of said zones are predetermined from compositions of retrieval raffinate and product stream of previous profile. By expansion the number of zones, the recycle streams are increased by the number of two in the next profile such that the purity and concentration of separated raffinate and product stream can be improved. Therefore, the amount of glucose and fructose original in a mixture of feed solution are continuously migrating through recycle streams toward two end of respective profiles until the pure component of respective sugar is obtained.

EXAMPLE 3

As illustrated in FIG. 6, total nine zones of liquids are collected as the results of sequential input of liquids of zone 3, 4, 60 cc of feed, 5, 6, 20 cc of zone 7, 24 cc of zone 9, 120 cc of eluent water, and zone 1. All streams have predetermined sugars concentration in between 5 to 60 D.S. % and composition in accordance with results in FIG. 5. The input volume of recycled stream of other unspecified stream is 30 cc. Total 10 cc of condensed water is collected during total 50 minutes of cycle time. Alike as those demonstrated in FIG. 5 that the raffinate as glucose enriched solution is recovered from zone 2 and the product as fructose enriched solution from zone 8. Note that the cycle time is increased from 36 to 50 minutes as three addition zones are incorporated into previous profiles to allow glucose and fructose to further migrate through added zones to end of respective profiles. The table 3 has listed the composition and concentration of retrieved raffinate and product, which demonstrates better separation results are obtained than those in six zone protocols.

TABLE 3

| Zone | Total Output | D.S. % | Recovery % | Glucose % | Fructose % |
|---|---|---|---|---|---|
| 2 | 22.2852 grams | 29.20 | 90.40% of glucose | 89.61 | 10.39 |
| 8 | 19.8856 grams | 35.80 | 90.30% of fructose | 10.58 | 89.42 |

For avoiding repeated description, the general conditions relevant to the following examples are described hereinafter, through which the procedures can be developed for leading to the separation result demonstrated in FIG. 2. The cell dimension is 0.95 cm in I.D. and 206 cm in bed height. The resin is filled to 195.6 cm in bed height and occupied total bed volume of 139.6 cc. The 36 cc of feed volume are delivered in each example inasmuch as the bed volume is smaller than that in earlier examples. Yet, such 36 cc are equivalent to 25.8% of resin bed volume. Other conditions are remained unchanged as previous examples.

EXAMPLE 4

Figure 7:
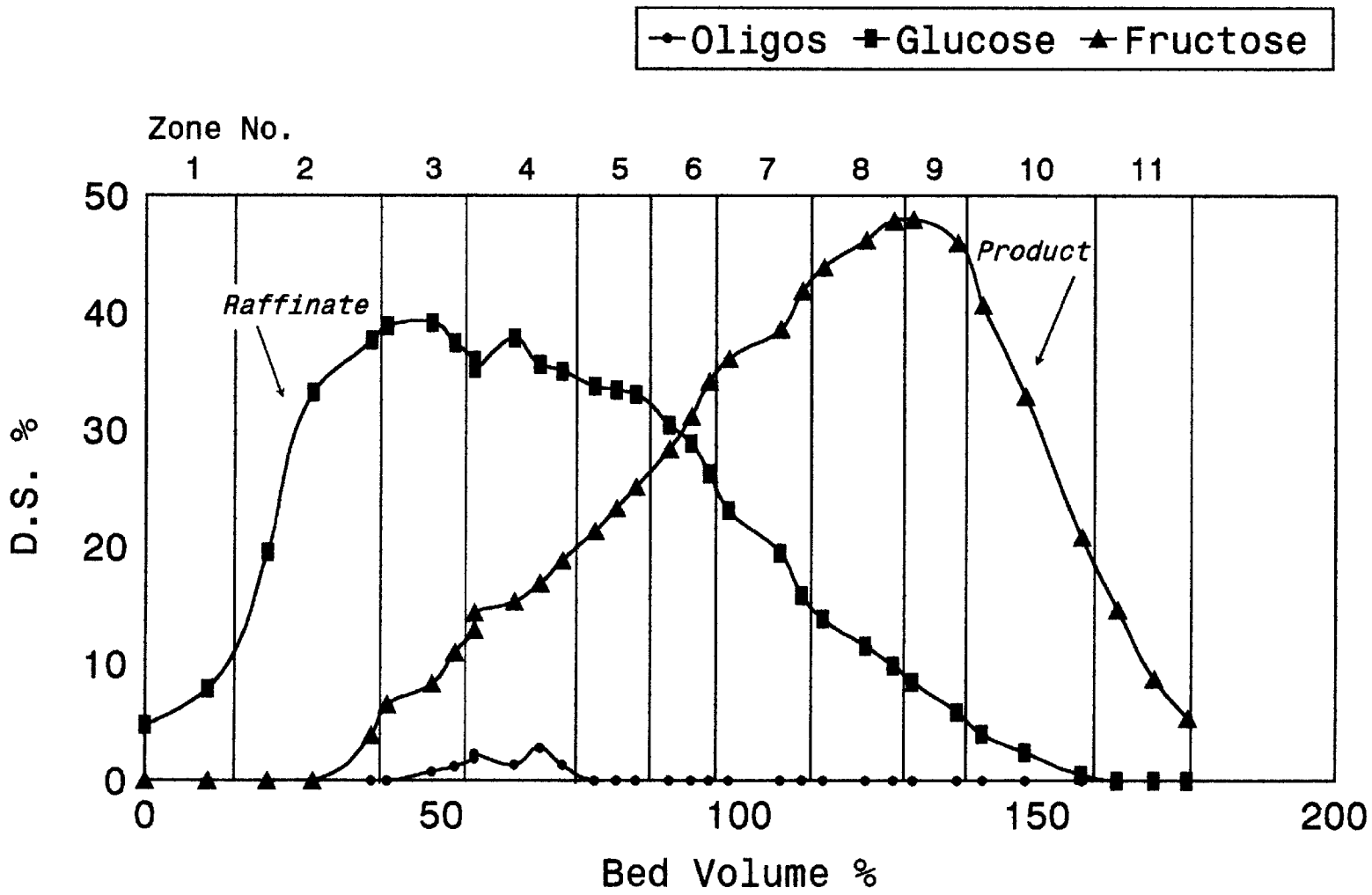

As illustrated in FIG. 7, total eleven zones of liquids are collected as the results of sequential input of liquids of zone 3, 4, 5, feed, 6, 7, 8, 9, 24 cc of zone 11, 63 cc of eluent water, and zone 1. Other unspecified input volume of predetermined recycled stream is 18 cc. Total 3 cc of condensed water is collected. In fact, the zone 3 and zone 9 are the added zones having compositions of two sugars as those specified in Table 3 of zone 2 and zone 8 respectively and each having predetermined concentration of 53 D.S. %. Other recycled streams of zones 3, 4, 5, 6, 7, 9 utilized in example 3 are renamed as zone 4, 5, 6, 7, 8, and 11 respectively with composition and concentration unchanged as liquid input indicated. Alike as those demonstrated in FIG. 6 that the raffinate as glucose enriched solution is recovered from zone 2 and the product as fructose enriched solution from zone 10. Note that the cycle time is increased from 50 to 60 minutes as two addition zones are incorporated into previous profiles to allow glucose and fructose to further migrate through added zones to end of respective profiles. The table 4 has listed the composition and concentration of retrieved raffinate and product, which demonstrates better separation results are obtained than those in nine zone protocols.

TABLE 4

| Zone | Total Output | D.S. % | Recovery % | Glucose % | Fructose % |
|---|---|---|---|---|---|
| 2 | 13.8567 grams | 31.23 | 93.44% of glucose | 95.43 | 4.57 |
| 10 | 12.1267 grams | 32.58 | 94.69% of fructose | 6.88 | 93.12 |

EXAMPLE 5

Figure 8:
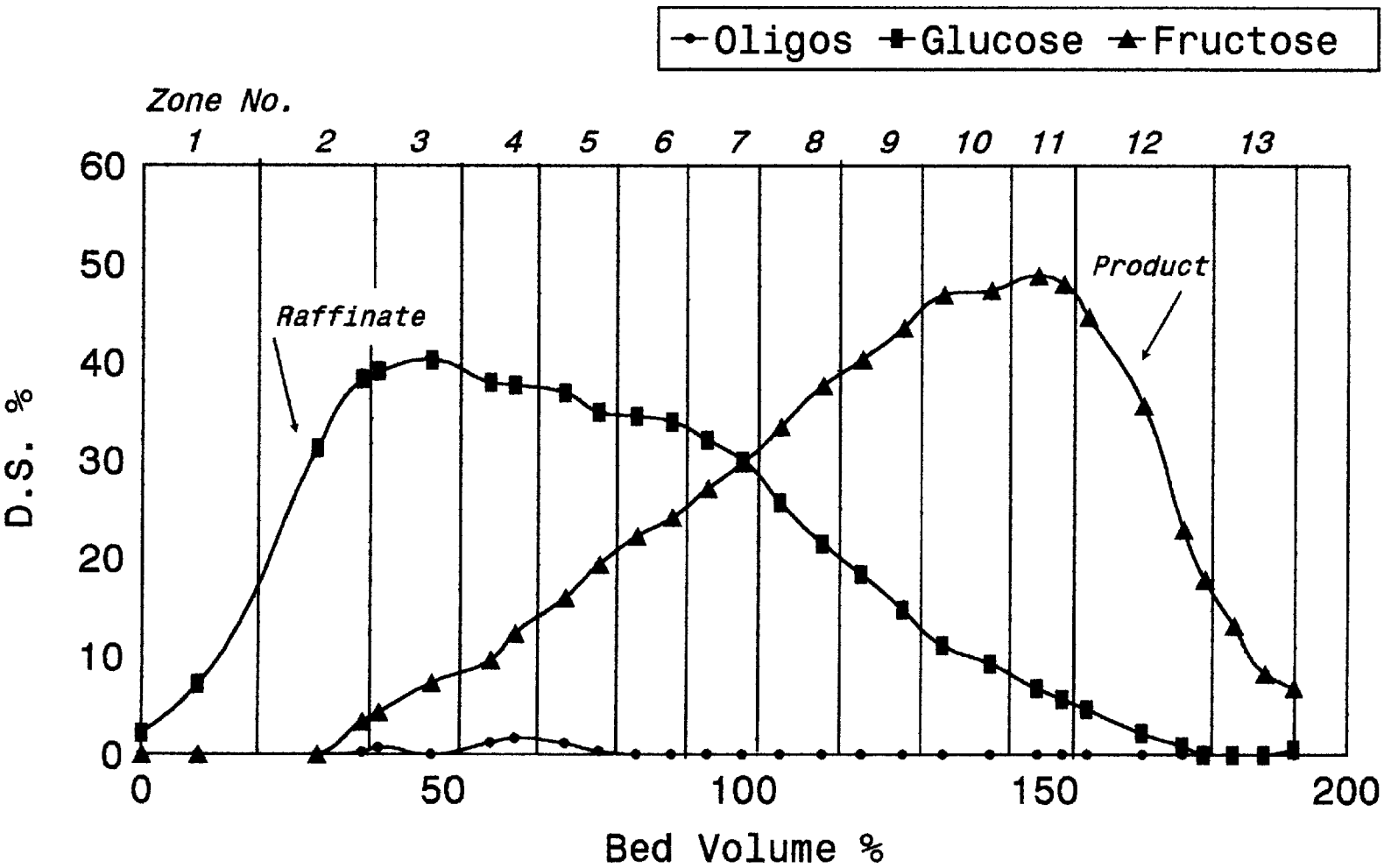

As illustrated in FIG. 8, total thirteen zones of liquids are collected as the results of sequential input of liquids of zone 3, 4, 5, 6, feed, 7, 8, 9, 10, 11, 24 cc of zone 13, 63 cc of eluent water, and zone 1. Total 3 cc of condensed water is collected. Other unspecified input volume of predetermined recycled stream is 18 cc. In fact, the zone 3 and zone 11 are the added zones having compositions of two sugars as those specified in Table 4 of zone 2 and zone 10 and each having predetermined concentration of 48 and 44 D.S. % respectively. Other recycled streams of zone 3, 4, 5, 6, 7, 9, 11 utilized in example 4 are renamed as zone 4, 5, 6, 7, 8, 10, and 13 respectively with compositions and concentration unchanged as liquid input indicated. Alike as those demonstrated in FIG. 7 that the raffinate as glucose enriched solution is recovered from zone 2 and the product as fructose enriched solution from zone 12. Note that the cycle time is increased from 60 to 68 minutes as two addition zones are incorporated into previous profiles to allow glucose and fructose to further migrate through added zones to end of respective profiles. The table 5 has listed the composition and concentration of retrieved raffinate and product, which demonstrates better separation results are obtained than those in eleven zone protocols.

TABLE 5

| Zone | Total Output | D.S. % | Recovery % | Glucose % | Fructose % |
|---|---|---|---|---|---|
| 2 | 14.1856 grams | 34.53 | 96.50% of glucose | 97.60 | 2.40 |
| 12 | 12.4183 grams | 32.58 | 98.06% of fructose | 5.83 | 94.17 |

Following two examples are illustrated for enhancing the concentration level of product from typical 30–35 D.S. % to a higher level as 50–55% D.S. % while the separation purity of product also enhanced. Yet, the same protocols can be applied it for raffinate by addition of predetermined zone into glucose profile.

EXAMPLE 6

Figure 9:
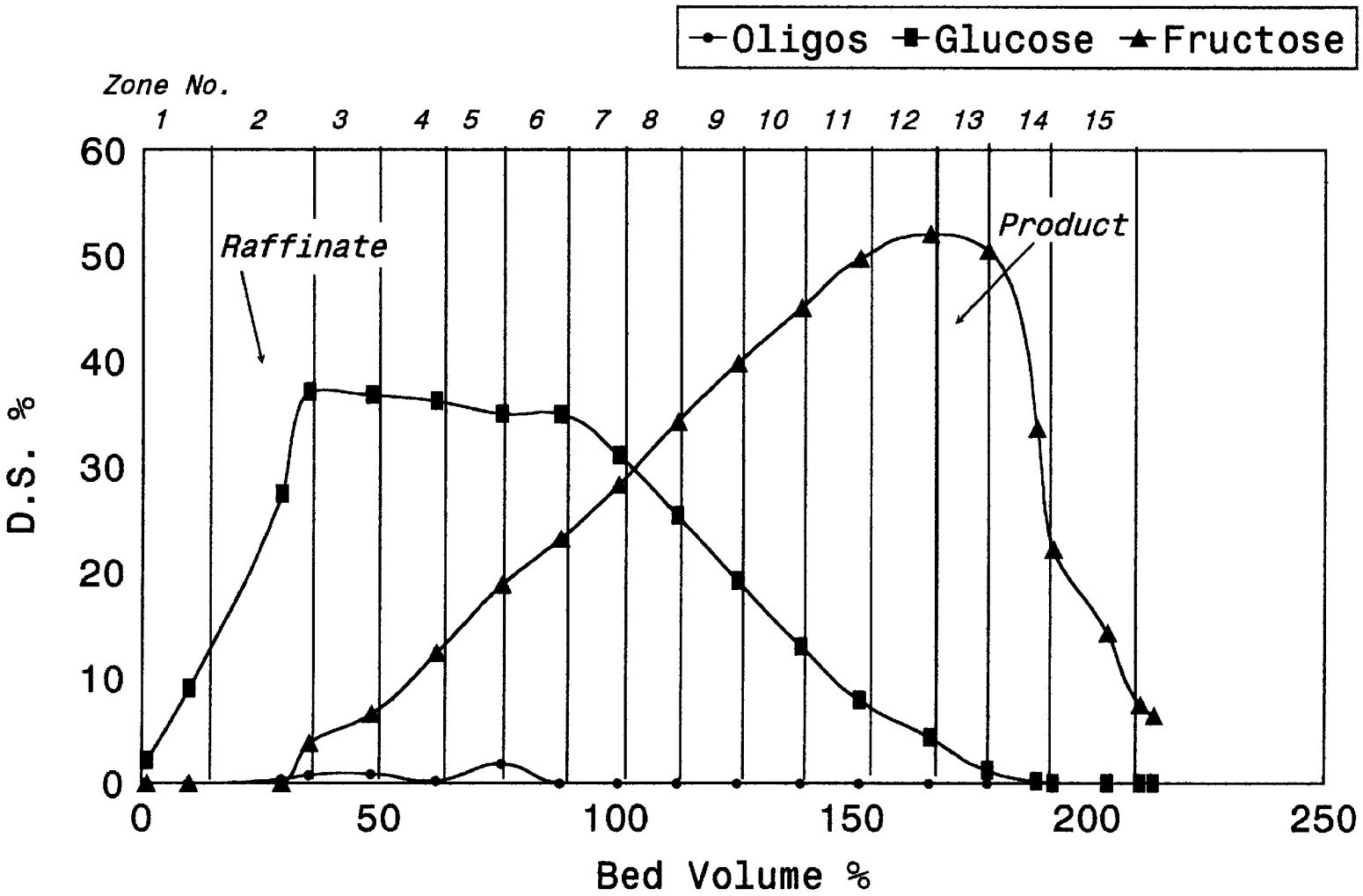

As illustrated in FIG. 9, total fifteen zones of liquids are collected as the results of sequential input of liquids of zone 3, 4, 5, 6, feed, 7, 8, 9, 10, 11, 12, 14, 21.6 cc of zone 15, 62 cc of eluent water, and zone 1. Total 5 cc of condensed water is collected. Other unspecified input volume of predetermine recycle stream is 18 cc. It is slightly different from previous examples that the zone 12 and zone 14 are the added zones. Zone 12 has compositions of two sugars as those specified in Table 5 of zone 12 with concentration at 55 D.S. % and zone 14 has composition of 100% fructose at 33 D.S. %. Other recycled streams of zone 3, 4, 5, 6, 7, 9, and 11 utilized in example 5 are with composition and concentration unchanged as liquid input indicated except zone 13 is renamed as zone 15. Slightly different from those demonstrated in FIG. 8 that the raffinate as glucose enriched solution is recovered form zone 2 and the product as fructose enriched solution from zone 13, which is the third to the last zone. Note that the cycle time is increase from 68 to 76 minutes as two addition zones are incorporated into previous profiles to enhance improvement only on fructose to further migrate through added zones to end of fructose profile. The table 6 has listed the composition and concentration of retrieval raffinate and product, which demonstrates better separation on product with elevated concentration than those in thirteen zone protocols. Note that the concentration of product is enhanced from usual 30–35 D.S. % to 52 D. S. % as indicated.

TABLE 6

| Zone | Total Output | D.S. % | Recovery % | Glucose % | Fructose % |
|---|---|---|---|---|---|
| 2 | 14.0146 grams | 33.85 | 94.85% of glucose | 97.33 | 2.67 |
| 13 | 11.8931 grams | 52.06 | 96.03% of fructose | 2.8 | 97.20 |

EXAMPLE 7

Figure 10:
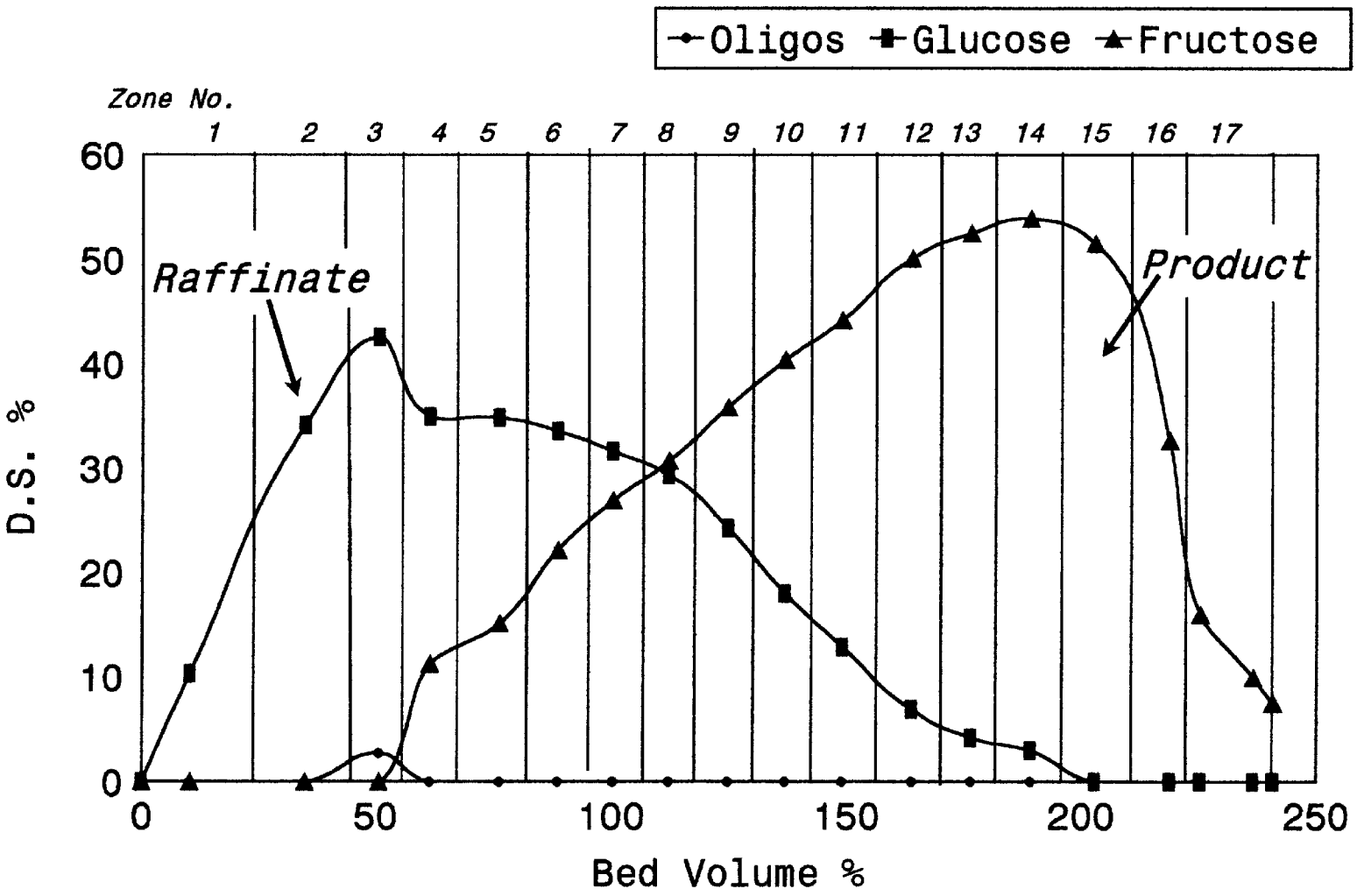

As illustrated in FIG. 10, total seventeen zones of liquids are collected as the results of sequential input of liquids of zones 3, 4, 5, 6, 7, feed 8, 9, 10, 11, 12, 13, 14, 22.5 cc of zone 16, 25.2 cc of zone 17, 58.5 cc of eluent water, and zone 1. Total 5 cc of condensed water is collected to make net water consumption of 53.5 cc in volume. Thus, the volume ratio of water to 36 cc of feed is 1.49. Other unspecified input volume of predetermined recycled stream is 18 cc. Again, it is slightly different from example 6. The zone 3 is the added zone having compositions of two sugars as those specified in Table 6 of zone 2 and having predetermined concentration of 45 D.X. %. Zone 14 is the other added zone having composition of 95% fructose and 5% of glucose at 55 D.S. %. Other recycled streams of zone 3, 4, 5, 6, 7, 8, 9, 10, 11, 12, 14, and 15 utilized in example 6 are renamed as zone 4, 5, 6, 7, 8, 9, 10, 11, 12, 13, 16, and 17 respectively with composition and concentration unchanged as liquid input indicated. Alike as those demonstrated in FIG. 9 that the raffinate as glucose enriched solution is recovered from zone 2 and the product as fructose enriched solution from zone 15. Note that the cycle time is increase from 76 to 86 minutes as two addition zones are incorporated into previous profiles to allow glucose and fructose to further migrate through added zones toward the end of respective profiles. The table 7 has listed the composition and concentration of retrieved raffinate and product, which demonstrates the ultimate separation results are obtained on both raffinate and product with elevated concentration. The concentration of nearly pure fructose product is elevated to over 51 D.S. % as indicated.

TABLE 7

| Zone | Total Output | D.S. % | Recovery % | Glucose % | Fructose % |
|---|---|---|---|---|---|
| 2 | 14.1520 grams | 35.7 | 100% of glucose | 100.00 | 0.00 |
| 15 | 11.9253 grams | 51.55 | 100% of fructose | 0.015 | 99.985 |

EXAMPLE 8

To handle a 200 gallons per minute of 60% D.S. feed throughput; the typical industrial unit of SMB process is designed as four columns having each in dimensions of 14 feet in I.D. and 27.5 feet in height. Each column is loaded with 4125 cubic-ft, or, 30,855 gallons per column, which is total of 123,420 gallons resin stock. The process requires 350 gallons per minute input rate of eluent water to retrieve 88% of fructose recovery as purity of 90% of fructose and 10% glucose. The comparison between SMB process and current disclosure is made in terms of resin stock and eluent consumption based on same throughput and feed composition. As indicated, the volume ratio of water to feed is 1.49, it means 298 gallons of eluent water is required based on 200 gallons throughput. The current disclosure has 85% water consumption compared to 350 gallons in traditional SBM process.

The volume ratio of feed input to bed volume is 0.258. The cycle time is 86 minutes in last example, which is 86 steps for one step per minute. The resin stock required for 86 minutes cycle time is calculated by 200 divided by 0.258 then times 86, which is equivalent to 66,6666.7 gallons to handle 200 gallons per minute feed throughput. In comparison to 123,420 gallons used up in SMB process, the results obtained from last example consume only 54% of resin based on same feed throughput. Furthermore, the cycle time relevant to obtaining results demonstrated in previous examples can be used to calculate the resin stock required installing in said apparatus in order to retain the separation results from protocols illustrated in corresponding examples.

I claim:

1. A method of separating glucose, fructose and oligosaccharide components from a feed solution containing said components comprising:

A) in each successive minimum time interval advancing at least on of each of a plurality of cells along a continuous line in steps to simultaneously deliver liquid from each of a plurality of holding tanks into a group of corresponding group of cells and to collect liquid from each cell;

wherein each of said holding tanks contains a liquid selected from feed solution, recycled solution mixtures and eluent;

wherein each cell comprises an inlet for liquid delivery, an outlet for liquid collection and, and an equal amount of solid phase packing material, wherein the cells are grouped into a plurality of zones with a corresponding zone compartment in communication with the outlet of each cell in that zone, wherein each zone compartment is connected to distribute the collected liquid to a corresponding holding tank containing a liquid selected from recycled solution mixtures, a raffinate of glucose enriched solution and, a product of fructose enriched solution;

wherein, during liquid collection from each of said cell outlets, said packing material maintains a partial dry status in which the surface of the packing material is wet while the liquid is drained away from the interstices of the packing material, wherein said delivery and collection of the fluid in each cell, in each step, completes mass transfer including the sorption of components of the delivered liquid onto the packing material and desorption of absorbed components from the packing material into the liquid to be collected;

B) wherein differential set up protocols are obtained by conducting a start up study then a steady state study, through single cell evaluation to produce at least one differential sorption and desorption profile where each profile is used to develop a particular single stage recycle procedure, wherein said single cell evaluation includes:

i) providing a study cell containing solid phase packing material, an inlet on one side of the packing material and an outlet on the other side of the packing material, ii) sequentially delivering one liquid selected from feed solution, a plurality of recycled solution mixtures and eluent, wherein each liquid is intermittently delivered in a plurality of different amounts in each of said minimum time interval into the inlet of the study cell, wherein during liquid collection from said outlet, said packing material maintains a partial dry status in which the surface of the packing material is wet while the liquid is drained away from the interstices of the packing material, wherein said delivery and collection of the fluid, completes mass transfer including the sorption of components of the delivered liquid onto the packing material and desorption of absorbed components from the packing material into the liquid to be collected;

iii) collecting the solution mixtures obtained and determining the relative composition and concentration of said components in each mixture to develop a sorption and desorption profile for the corresponding said protocol to establish particular single stage recycle procedures, wherein said protocol comprises sequential delivery of different amounts of said liquid phase feed solution, a plurality of liquid mixtures for recycling and an eluent and, wherein said profile comprises steady relationships between said solid phase packing material and collected solution mixtures, indicating a particular composition and concentration, which include a raffinate of glucose enriched solution, a product of fructose enriched solution and, a plurality of solution mixtures for recycling.

2. The method of claim 1 wherein said solid phase packing material in one cell is a strongly acidic cation exchanger of one type of alkaline earth metal base retained on a porous mesh screen.

3. The method of claim 2 wherein said solid phase packing material is one cell is a calcium base strongly acidic cation exchanger retained on a porous mesh screen.

4. The method of claim 1 wherein said liquid phase feed solution is an aqueous liquid solution containing dissolved components of glucose, fructose, and oligosaccharide in a concentration between 10 percent and 70 percent of total dry solid.

5. The method of claim 4 wherein said aqueous liquid solution contains said dissolved components in dirt-free water and is free of ionic substances that would hinder the sorption capacity of the solid phase packing material contained in one cell.

6. The method of claim 1 wherein the eluent is dirt-free water and is free of ionic substances that would hinder the sorption capacity of the solid phase packing material contained in one cell.

7. A method of separating glucose, fructose and oligosaccharide components from a feed solution containing said components comprising:

in each successive minimum time interval advancing at least on of each of a plurality of cells along a continuous line in steps to simultaneously deliver liquid from each of a plurality of holding tanks into a group of corresponding group of cells and to collect liquid from each cell;

wherein each of said holding tanks contains a liquid selected from feed solution, recycled solution mixtures and eluent;

wherein each cell comprises an inlet for liquid delivery, an outlet for liquid collection and, and an equal amount of solid phase packing material, wherein the cells are grouped into a plurality of zones with a corresponding zone compartment in communication with the outlet of each cell in that zone, wherein each zone compartment is connected to distribute the collected liquid to a corresponding holding tank containing a liquid selected from recycled solution mixtures, a raffinate of glucose enriched solution and, a product of fructose enriched solution;

wherein, during liquid collection from each of said cell outlets, said packing material maintains a partial dry status in which the surface of the packing material is wet while the liquid is drained away from the interstices of the packing material, wherein said delivery and collection of the fluid in each cell, in each step, completes mass transfer including the sorption of components of the delivered liquid onto the packing material and desorption of absorbed components from the packing material into the liquid to be collected.

8. The method of claim 7 wherein said solid phase packing material in one cell is a strongly acidic cation exchanger of one type of alkaline earth metal base retained on a porous mesh screen.

9. The method of claim 8 wherein said solid phase packing material is one cell is a calcium base strongly acidic cation exchanger retained on a porous mesh screen.

10. The method of claim 7 wherein said liquid phase feed solution is an aqueous liquid solution containing dissolved components of glucose, fructose, and oligosaccharide in a concentration between 10 percent and 70 percent of total dry solid.

11. The method of claim 10 wherein said aqueous liquid solution contains said dissolved components in dirt-free water and is free of ionic substances that would hinder the sorption capacity of the solid phase packing material contained in one cell.

12. The method of claim 7 wherein the eluent is dirt-free water and is free of ionic substances that would hinder the sorption capacity of the solid phase packing material contained in one cell.

* * * * *